US007481251B2

(12) United States Patent
Lin et al.

(10) Patent No.: US 7,481,251 B2
(45) Date of Patent: Jan. 27, 2009

(54) TEXTILE WITH TRANSPARENT LIGHT STRUCTURE AND HEAT-INSULATING CONSTRUCTION AND METHOD OF MANUFACTURING THE SAME

(75) Inventors: Jian-Min Lin, Tu-Chen (TW); Jen-Chi Chao, Tu-Chen (TW); Shu-Fen Chen, Tu-Chen (TW)

(73) Assignee: China Textile Institute, Taipei Country (TW)

( * ) Notice: Subject to any disclaimer, the term of this patent is extended or adjusted under 35 U.S.C. 154(b) by 854 days.

(21) Appl. No.: 10/964,659

(22) Filed: Oct. 15, 2004

(65) Prior Publication Data

US 2005/0183251 A1 Aug. 25, 2005

(30) Foreign Application Priority Data

Feb. 17, 2004 (TW) ..... 093104034 A

(51) Int. Cl.
*D03D 15/04* (2006.01)
*D03D 15/08* (2006.01)
*D03D 25/00* (2006.01)

(52) U.S. Cl. ..... 139/420 A; 139/383 R; 139/426 R; 139/420 R; 139/384 A

(58) Field of Classification Search ..... 139/383 R, 139/420 A, 426 R, 423, 420 R, 384 A
See application file for complete search history.

(56) References Cited

U.S. PATENT DOCUMENTS 2,077,692 A * 4/1937 Helwith ..... 139/420 R
2,171,513 A * 8/1939 Wiess ..... 8/114.5
2,182,323 A * 12/1939 Seymour ..... 428/393
2,215,938 A * 9/1940 Schonholzer ..... 442/2
2,275,851 A * 3/1942 Heberlein et al. ..... 8/114.5
2,466,066 A * 4/1949 Weiss ..... 428/196
2,510,919 A * 6/1950 Weiss ..... 428/196
2,687,673 A * 8/1954 Boone ..... 359/497
3,315,559 A * 4/1967 Cohen ..... 87/2
3,702,053 A * 11/1972 Schoots et al. ..... 428/457
4,519,017 A * 5/1985 Daniel ..... 362/565
4,715,700 A * 12/1987 Daniel ..... 385/31
5,183,323 A * 2/1993 Daniel ..... 362/556
5,249,105 A * 9/1993 Koizumi ..... 362/605
5,400,848 A * 3/1995 Gainer ..... 160/238
5,454,414 A * 10/1995 Colson et al. ..... 160/84.02
5,664,613 A * 9/1997 Jelic ..... 160/84.05
5,712,007 A * 1/1998 Mercuri ..... 428/34.8
5,791,392 A * 8/1998 Fernandez Lopez ..... 160/238
6,120,901 A * 9/2000 Ojeda ..... 428/421
6,256,811 B1 * 7/2001 Nelson ..... 5/53.1
6,582,794 B1 * 6/2003 Fransen ..... 428/101
6,672,361 B2 * 1/2004 Fransen ..... 160/85
6,688,369 B2 * 2/2004 Colson et al. ..... 160/121.1
6,848,803 B2 * 2/2005 Spongberg ..... 362/103

(Continued)

*Primary Examiner*—Bobby H Muromoto, Jr.
(74) *Attorney, Agent, or Firm*—Rosenberg, Klein & Lee

(57) ABSTRACT

A textile with transparent light structure and heat-insulating construction and the method of manufacturing the same comprise a surface layer and an underlying layers the underlying layer and the surface layer have air layers and high shrinkage-rate yarns therein, and include non-transparent weft yarns and transparent yarns. By controlling the non-transparent yarn and the transparent yarn, the transparent light property can be obtained. Further, through the heat treatment, the multiple high shrinkage-percentage yarns thereto contract to make the surface layer and the underlying layer individually protruded. The air layers are just the heat insulating factor of the textile.

14 Claims, 5 Drawing Sheets

U.S. PATENT DOCUMENTS

2002/0007923 A1* 1/2002 Colson et al. ..... 160/121.1
2003/0019590 A1* 1/2003 Fransen ..... 160/87
2003/0091758 A1* 5/2003 Osumi et al. ..... 428/34
2004/0029472 A1* 2/2004 Lin ..... 442/131
2004/0050506 A1* 3/2004 Haiber et al. ..... 160/330
2004/0084158 A1* 5/2004 Colson et al. ..... 160/84.05
2004/0149396 A1* 8/2004 Colson et al. ..... 160/121.1
2004/0154755 A1* 8/2004 Judkins ..... 160/84.05
2007/0058260 A1* 3/2007 Steenblik et al. ..... 359/626

* cited by examiner

TEXTILE WITH TRANSPARENT LIGHT STRUCTURE AND HEAT-INSULATING CONSTRUCTION AND METHOD OF MANUFACTURING THE SAME

BACKGROUND OF THE INVENTION

1. Field of the Invention

The present invention relates to a textile with transparent light structure and heat-insulating construction and the method of manufacturing the same. More particularly, it refers to a textile comprising a surface layer and an underlying layer. Through the multiple high shrinkage-rate yarns, an air layer is formed between the surface layer and the underlying layer, thus having the heat insulating effect. Further, the transparent and non-transparent weft yarns are adopted in the surface layer and underlying layer to facilitate the transparent light function.

2. Description of the Related Art

Accordingly, the upholstery textile has been ever increasingly tending to meet the social requirements of a comfortable and healthy life in recent years. As a result, the upholstery textile is trending to the development of functional features, especially the dominant trend in anti-radiance, light shielding, UV light shielding, and heat insulating. Additionally, with the concerns about the converging of function and trend, most of the foreign developed countries have adopted the combination of the designs in evolving the material and textile construction to facilitate the functionality of the upholstery textile, thus resulting in the increasing delicate, systematical, and aesthetic trends.

Light-shielding textile products are widely used nowadays, such as window curtain, sun canopy, sun umbrella, beach umbrella, and garden umbrella. Because of the advancing technology, the applications of the textile products are expanding in parallel with the soaring requirement of the sun-shading textile. From the need in improving the sun shading in the windows of house, the textile of sun curtain is indeed an economical choice. The dominant function of the sun curtain is to block the sunlight penetration, and if the accessory function of transparent light to offer the indoor illumination can be included, it would significantly advance the commercial value of sun-shielding curtain. Generally, sun curtain with light shielding only requires increasing the textile density, or dyeing into dark color, or even filling up the gap by coating process. However, in order to meet the adequate transparent light and heat-insulating functions at once, the textile construction would be obliged to be modified. From the previous sun curtain with a pure light shielding function to one with adequate transparent light and heat-insulating as well, it requires to consider the textile construction with blocking the direct sunlight from some specialized angles, but allowing the scattering light to penetrate.

As the disclosed light shielding textile in Japanese patent No. 09-000425, wherein the multiple construction textile is formed of the light-shielding yarn of thermoplastic synthetic fiber and non-light-shielding yarn of facile thermal deformation. In which, the surface is made of said non-light-shielding yarn with said light shielding yarn embedded there-under, which is heated and pressed into compact shape, and forms a light-shielding layer inside, thus constructing a textile with the function of light shielding.

As the improved structure of light-shielding screen in Taiwan patent No. 423534, wherein the screen is dominantly made of the flat weaving of warp yarn and weft yarn. Its characteristic is the rising warp of the light-shielding screen with a flat yarn wove on each adequate distance so as to advance the light shielding and ventilation. Wherein, said flat yarn is clad with an aluminum layer.

As the light-penetrable textile with incongruous direction and the method of manufacturing the same in the Japanese patent 2001-271246, wherein the permeable incident light is decreased from the vertical direction of the cloth while the transmittancy of the incident light from the inclinatory direction of warp yarn is prompted comparatively. Therefore, it can not only advance the light-shielding function of perspective, but also facilitate the transparent light effectively as well. Adopting the multi-layer construction textile of 3-7 layers, with warp yarn of luster cloth and weft yarn of light-shielding function, the interstice is formed by the designed construction so as to facilitate the effective penetration of the incident light from the comparatively inclinatory direction of the warp yarn.

3M had claimed for the U.S. Pat. No. 6,120,901 under the patent subject—UV protected syndiotactic polystyrene overlay films on Sep. 19, 2000, wherein said UV protected film can retain the robust dimensional stability under extreme environment with the manufactured syndiotactic polystyrene (sPS) film of macromolecule capable of low moisture absorption, excellent thermal stability, and high transparency. When used in combination with a UV-blocking coating, the sPS film exhibits a degree of resistance to UV-induced discoloration and degradation that is substantially superior to unprotected sPS films or films based on sPS resins that are merely compounded with a UV absorber, and can be applied to signals and any outdoor UV protected applications.

In addition, U.S. Pat. No. 6,475,609, claimed on Nov. 5, 2002, shows color shifting film glitter, wherein the glitter, at least a portion of which comprises color shifting film. The glitter is useful in any of a variety of ways, including in loose form, attached to the surface of a substrate, or in a dispersible combination.

Further, as the Japanese patents No. 09-000425, and TW423534, wherein the main drawbacks are:

1. The light shielding yarn is used to produce the light shielding effect, and to advance the light-shielding rate the flatness of the yarn must be increased. However there are some difficulties in the spinning and weaving of the yarn with high flatness.
2. The post finishing method of heating and pressing the yarns to flat to achieve the advanced light shielding effect would easily cause the thermo-dissociation of textile and deterioration of the material.
3. The surface of flat yarn is covered with an aluminum layer to achieve the light shielding effect. However, this practice would prompt the cost and cause the weaving difficulty.
4. In order to meet the present consumers requirement on the light shielding textile product, it tends to contain both transparent light and heat-insulating characters. Therefore, the product with only transparent light character is out of date for the market demand.

Further, the main shortages in J.P. 2001-271246 are shown as following:

1. The structure of multiple layers with 3 to 7 layers is difficult to implement the weaving.
2. The spacing of the multiple-layer textile cannot be accurately controlled and friendly adjusted, which may affect the anisotropic effect.
3. The same structure with different types of yarn would result in large difference in anisotropic directions. Therefore, it limits the types of the yarn for the usage.
4. In order to enhance the light permeability of oblique transmission, it decreases the light shielding efficiency in the vertical direction.

5. It only has an anisotropic transparent light effect, but lacks of heat-insulating characteristic.

Finally, the main disadvantages in U.S. Pat. No. 6,120,901, U.S. Pat. No. 6,475,209 are shown as the followings:

1. It only can be coated or adhered on the transparent surface, but not applied to sun canopy, garden umbrella, tent, or other outdoor-related textile products.
2. Thin film cannot be used as the design for the graph and the color.
3. Thin film cannot be used individually.

According to the afore-mentioned problems, to provide a novel textile with transparent light and heat-insulating construction and the method of manufacturing the same—which has always been the concern of the inventor for a long time not only can improve the difficulty in conventional weaving but also conquer the shortage of inevitably adopting special flat yarn or special post finishing. Besides, it can also arbitrarily control and adjust the light textile with heat insulating effect. Based on the engagement in the research, development, and practical sales experience in the related products of textile for many years, the idea of invention has been in embryo, and finally, a kind of construction of light textile with heat-insulating function and improved method of manufacturing the same have been figured out via the dedicated personal professional knowledge, study design, and seminars to conquer the above-mentioned problems.

SUMMARY OF THE INVENTION

The main object of the present invention is to provide a textile with transparent light structure and heat-insulating construction and the method of manufacturing the same. The textile comprises a surface layer and an underlying layer. The weft yarn of the said underlying layer and the surface layer includes a non-transparent weft yarn and a transparent yarn. By controlling the arrangement and ratio of the non-transparent yarn and the transparent yarn, the transmittancy of the textile can be adjusted. Further, through the high shrinkage-rate yarn, the air layer can be obtained on both the surface and underlying layers, thus constructing the heat-insulating effect. As a result, the textile in the present invention contains the transparent light and heat-insulating effects.

The second purpose of the present invention is to offer a textile with transparent light structure and heat-insulating construction and method of manufacturing the same, wherein the counter position of the underlying and surface layers' transparent yarns and non-transparent yarns is used to contain the permeable quantity of light—the controlling of transparent light.

Another object of the present invention is to provide a textile with transparent light structure and heat-insulating construction and the method of manufacturing the same, wherein the shrinkage rate of the multiple high shrinkage-rate yarns is controlled to contain the air layer thickness among the surface layer, underlying layer, and the multiple high shrinkage-rate yarns so as to advance or punch down the heat-insulating effect and control the thickness of the textile as well.

To achieve the afore-mentioned purposes and functions, the present invention is related to a textile with transparent light structure and heat-insulating function and method of manufacturing the same. Wherein the present invention discloses a textile with transparent light and heat-insulating effects comprises a surface layer and an underlying layer, and the weft yarns of said underlying and surface layers include a non-transparent yarn and a transparent yarn. Via controlling the arrangement and ratio of the non-transparent yarn and transparent yarn, the transparent light of the textile can be managed. Further, the counter position of the non-transparent and transparent yarns on the surface of underlying layer blocks the direct sunlight from radiating into the inside of the textile directly, while the soft oblique light of the sunrise and sunset is permeable, wherein the angle of the oblique sunlight accepted by the textile can be controlled by the arrangement and ratio of the non-transparent yarn and transparent yarn.

Moreover, the high shrinkage-rate yarn between the said underlying layer and surface layer would contract through the thermal treatment, thus causing the said surface and underling layers protruding to form a three-dimensional structure individually. In addition, the various thickness of textile can be managed by controlling the shrinkage rate of the high shrinkage-rate yarn, and then the different shrinkage rates would also contribute to the varied air layer thickness of the said underlying layer, surface layer, and multiple high shrinkage-rate yarns. Wherein said air layer is the heat-insulating reason of the textile. Therefore, the varied heat-insulating effect can be managed by controlling said shrinkage rate.

DETAILED DESCRIPTION OF THE PREFERRED EMBODIMENT

To have a further understanding about the features of the structure and the achieved effects, of the present invention, the preferred embodiment and detailed description are unfolded as following.

The present invention is to solve the problems in the prior arts, such as (1) light shielding textile such as JP 09-000425 and TW 423534; (2) the textile of light transparency with anisotropy and the method of fabricating the same such as JP 2001-271246; (3) light-shielding thin film such as U.S. Pat. No. 6,120,901, U.S. Pat. No. 6,475,209, and etc. The weft of the surface layer and the underlying layer is used by the present invention, wherein the weft yarn, which comprises a non-transparent yarn and transparent yarn, facilitates the transmittancy and weaving. Besides, the different shrinkage rates between the high shrinkage-rate yarn and monofilament are used to produce three-dimensionally structuralized textile thereto increase the interstice of the textile and achieve significant heat-insulating effect.

Figure 1:
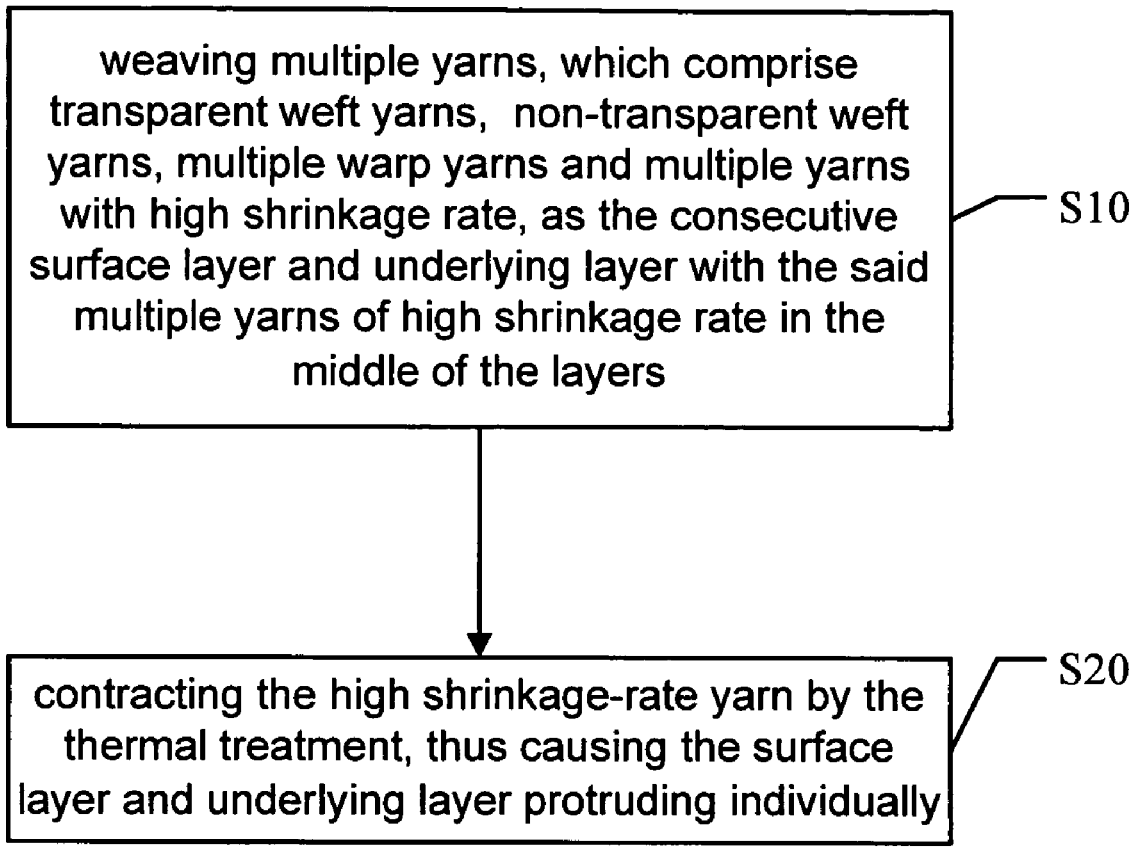
FIG. 1 illustrates one preferred embodiment of the manufacturing flow chart in the present invention.

As shown in FIG. 1, which is the manufacturing process of one of the preferred embodiments of this invention, wherein the manufacturing method of textile with transparent light structure and heat-insulating construction mainly comprise:

Step S10: weaving multiple yarns, which comprise transparent weft yarns, non-transparent weft yarns, multiple warp yarns and multiple yarns with high shrinkage rate, as the consecutive surface layer and underlying layer with the said multiple yarns of high shrinkage rate in the middle of the layers; and Step S20: contracting the high shrinkage-rate yarn by the thermal treatment, thus causing the surface layer and underlying layer protruding individually.

In step 10, the surface layer, the underlying layer, and the multiple high shrinkage-rate yarns are woven at the same time instead of the individual weaving. The weft yarn of the surface layer and the underlying layer individually includes the transparent yarn and the non-transparent yarn. In step 20, the thermal treatment is used to contract the multiple high shrinkage-rate yarns so as to produce protrusions of the surface layer and the underlying layer. From the appearance, it is a three-dimensional, and it is a tree-dimensional construction from the structure as well. And the weft yarn, which comprises the transparent yarn and non-transparent yarn, of the surface layer and underlying layer facilitate the transparent light effect of the textile, while the heat insulating effect is achieved via the three-dimensional construction made of the multiple high shrinkage-rate yarns.

Figure 2A:
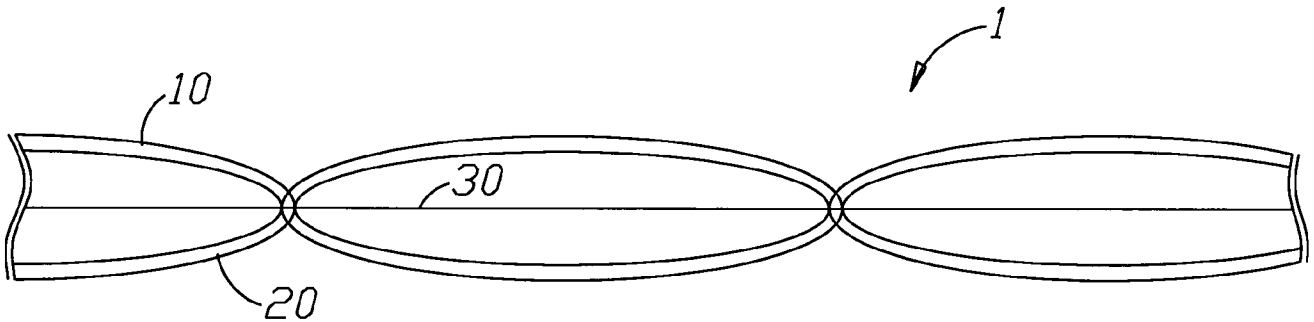
FIG. 2A illustrates one of preferred embodiment of the structures before thermal treatment in the present invention.
Figure 2B:
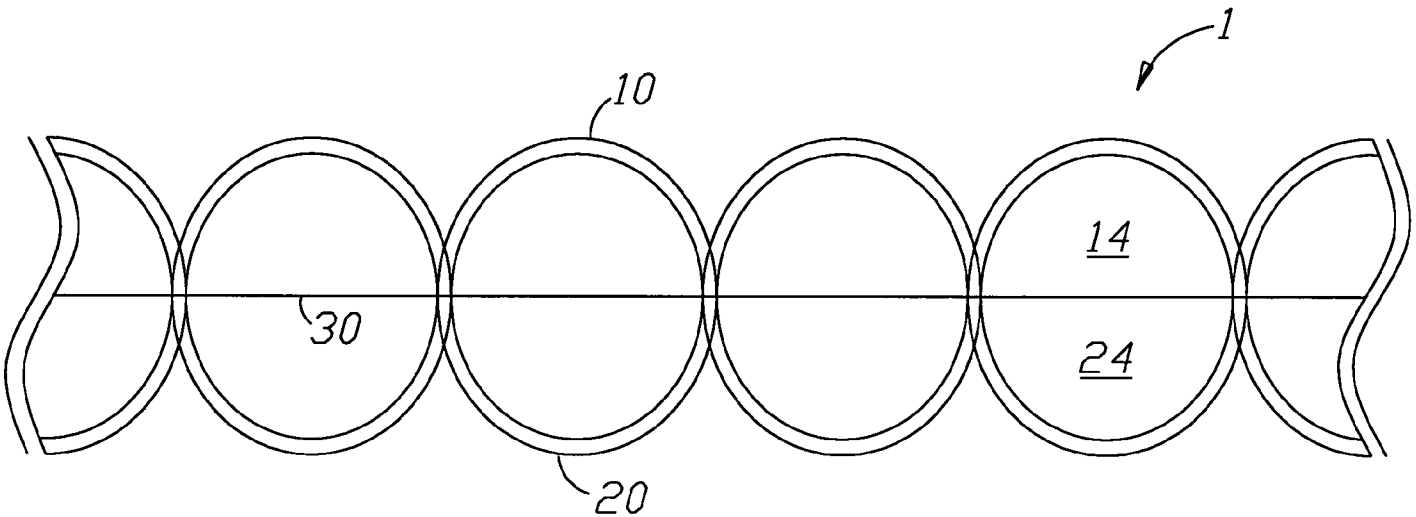
FIG. 2B illustrates one of preferred embodiment of the structures after thermal treatment in the present invention.
Figure 3A:
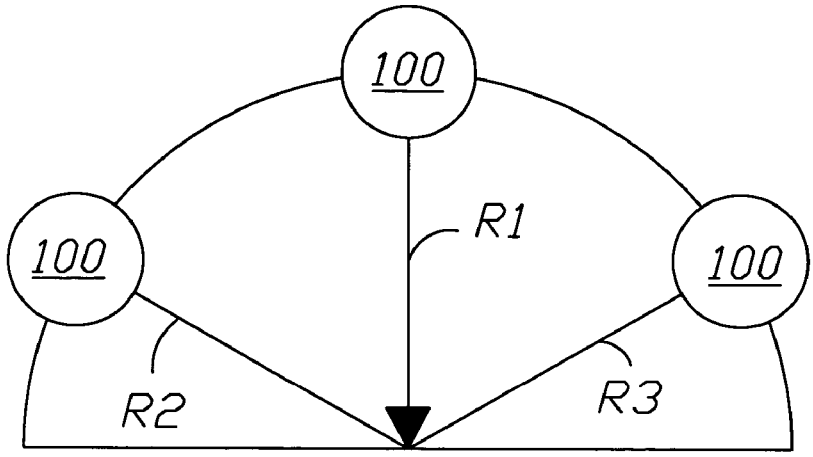
FIG. 3A illustrates the pathway under the sunlight during the daytime.
Figure 3B:
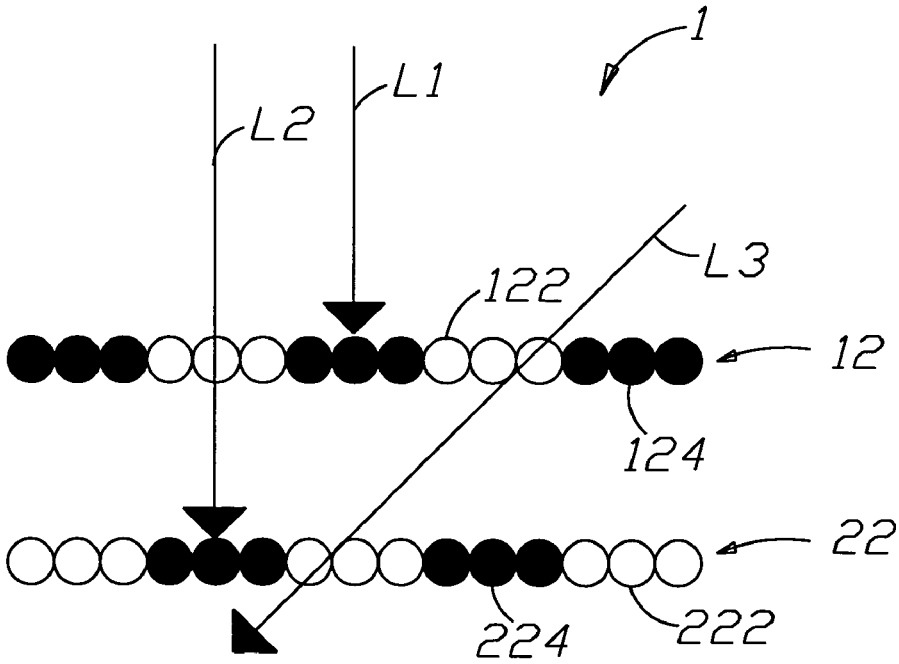
FIG. 3B is one of the preferred embodiments in the present invention showing the light and heat-insulating textile product under the sunlight.

As shown in FIGS. 2A, 2B and 3B, which are three of the preferred embodiments of the present invention, wherein the structures before and after the thermal treatment and the light textile with heat insulating effect under the sunlight are depicted. In these figures, the textile with transparent light and heat insulating construction 1 mainly comprises: a surface layer 10, multiple high shrinkage-rate yarns 30, and an underlying layer 20.

Wherein the surface layer includes a first weft yarn 12, which comprises a first transparent yarn 122 and a first non-transparent yarn 124. The multiple high shrinkage-rate yarns 30 are under the surface layer 10 with the underlying layer 20 there-under, wherein the underlying includes a second weft yarn 22. The second weft yarn 22 comprises a second transparent yarn 222 and a second non-transparent yarn 224. By controlling the first transparent yarn 122, the first non-transparent yarn 124, the second transparent yarn 222, and the second non-transparent yarn 224, the textile with different transmittancy can be available.

The transmittancy depends on the arrangement and ratio of the transparent yarn and the non-transparent yarn on the surface layer 10 and the underlying layer 20, wherein the ratio is between 1/5 and 5/1. The arranged position of the transparent yarn 122 and the non-transparent yarn 124 of the surface layer 10 is in the opposite direction to the second transparent yarn 222 and the second non-transparent yarn 224 of the underlying layer 20.

Moreover, after the weaving as shown in FIG. 2A, the subsequence is shown in FIG. 2B after the thermal treatment. In this circumstance, in the middle of the surface layer 10 and multiple high shrinkage-rate yarns 30, a first air layer 14 is included. The volume of the first air layer 14 of the textile product 1 is 10%~49%. Further, a second air layer 24 is included in the middle of the underlying layer 20 and multiple high shrinkage-rate yarns 30. The volume of the second air layer 24 of said textile product 1 is 10%~49%. Through the first air layer 14 and the second air layer 24, the present invention has the heat insulating function. In addition, the multiple high shrinkage-rate yarns with shrinkage rate of 20%~60% and yarn of 50~1000 denier are adopted in the present invention.

As shown in FIG. 3A, wherein the pathway under the sunlight during the daytime is illustrated. In the figure, the highest temperature in a normal day is at noon, when the pathway of the direct sunlight to the ground of the sun 100 is R1. Additionally, as the pathways of daybreak R2 and sunset R3, the temperatures are lower with the oblique radiation to the ground of the sun 100. Such being the case, the transparent light effect can be achieved by blocking the direct sunlight with appropriate oblique light permeable, wherein the three-dimensional construction even facilitates the heat insulating effect of the woven textile, thus obtaining the double functions of heat insulating and transparent light and having the effect of balancing temperature.

As shown in FIG. 3B, the direct sunlight are illustrated such as pathway L1 and L2. In pathway L1, the first non-transparent yarn 124 of said surface layer 10 in the present invention is used to produce a shielding effect. While in path L2, the second non-transparent yarn 244 of said underlying layer 20 in the present invention is used to produce another shielding effect. Therefore, the arrangement and ratio of the non-transparent yarns of the underling layer 20 and the surface layer 10 in the present invention are utilized to shield the direct light. While the oblique sunlight such as sunrise or sunset, the sunlight is much weaker and tender than at noon as the illustration of path L3, wherein the tender light is permeable through the first transparent yarn 122 of the surface layer 10, and the second transparent yarn 222 of the underlying layer 20.

EXAMPLE

1. Warp yarn:
   A. 65D polyester monofilament
   B. 75D anti-UV-PET
   Weft yarn:
   A. 450D high shrinkage EPT
   B. 120D polyester monofilament
   C. 150D anti-UV-PET
2. Starch ingredients:
   A. PVA: BP08 (60%)
   B. acrylic resin: J209 (39%
   C. auxiliary (anti-static agent: TS214 (1%)
3. Sizing conditions:
   A: starch density: 12%
   B: speed: 220 m/min
   C: temperature: 55° C.
4. Warping conditions:
   A: two beams: A axis, B axis
   B: total number of warp yarn: A5568+B5648
   C: total width of warp: 70"
   D: total length of warp: A63m+B56m
   E: warping speed: 500 m/min
5. Textile manufacturing conditions:
   A: warp density: 160 pick/inch
   B: weft density: 120 pick/inch
   C: reed: #80/2"
   D: reed space: 70"
   E: selvedge: (8 #×5 pick)×2=80F
   F: tuck in: 2784#×4 pick=11136F
6. Thermal treatment temperature: 120° C.

Inspection Method

1. Light permeability:
   A. JIS L1055 A method: measuring the transmittancy of the direct light to the textile by illuminometer.
   B. Image analysis system: observing the transmitted image and transmittancy of the lights from different angles to the textile.
2. Ultraviolet (UV) shielding efficiency: ASHRAE 74-1988 Procedure A, Appendix B1.1 SHIMADZU UV-3101 (PC)S
3. Gap ratio of the textile: densimeter—helium gas expelling method
4. Heat resistance value r: ALAMBETA testing apparatus
5. Heat retaining rate:
   The open heating experiment is conducted by setting a cloth, 50 cm×50 cm, 30 cm from the 500 W halogen light. After 40 minutes of radiating, measuring the temperature of the rear of the cloth. The heat retaining rate is calculated at the temperature of T1, which is measured 5 cm away from the rear of the cloth, and the temperature $T_0$, which is measured at the same position without the shielding of the cloth.

Result Analysis

JIS L1055 A method: The JIS L1055 A method is proceed to analysis the transmittancy of the textile. The result is shown as table 1.

| | Textile Sample Classification | | |
|---|---|---|---|
| | A | B | C |
| Arrangement Ratio of Warp Yarn | [(A1B1) × 12]<br>[(B1A1) × 24]<br>[(A1B1) × 12]<br>{ [(E1D1) × 4]<br>C1 } × 4<br>{ [(D1E1) × 4]<br>C1 × 4} | [(A1B1) × 12]<br>[(B1A1) × 24]<br>[(A1B1) × 12]<br>{ [(E1D1) × 4]<br>C1 } × 3<br>{ [(D1E1) × 4]<br>C1 × 2} | [(A1B1) × 12]<br>[(B1A1) × 24]<br>[(A1B1) × 12]<br>{ [(E1D1) × 4]<br>C1 } × 2<br>{ [(D1E1) × 4]<br>C1 × 2} |
| Arrangement Ratio of Weft Yarn | Transparent yarn:opaque yarn = 4:4 | Transparent yarn:opaque yarn = 3:2 | Transparent yarn:opaque yarn = 2:2 |
| Textile Thickness | 3.97 mm | 3.95 mm | 3.94 mm |

As the test result, the comparison is Textile Sample C>Textile Sample B>Textile Sample A from the aspect of transmittancy because the transparent textile compared to non-transparent textile of Textile Sample C is 2:2, which shortens the hiatuses and prompts the number of hiatus per square, thus pumping up the whole transmittable area and advancing the parallel transmittancy. From the experiment, it also manifests that the purpose of adjusting and controlling the transmittancy can be managed by changing the arrangement and ratio of transparent textile and non-transparent textile combined with appropriate construction design.

TABLE 1

Experimental Results Showing the Transmittancy of the Three-dimensional Soft Textile

| | Sample Label | | |
|---|---|---|---|
| | A | B | C |
| Illumination (Lux) | 145 | 162 | 182 |
| Transmittancy (%) | 9.67 | 10.8 | 12.1 |

Note:
Illumination of the blank experiment is 1500 Lux.

Image Analysis Technique

Figure 4:
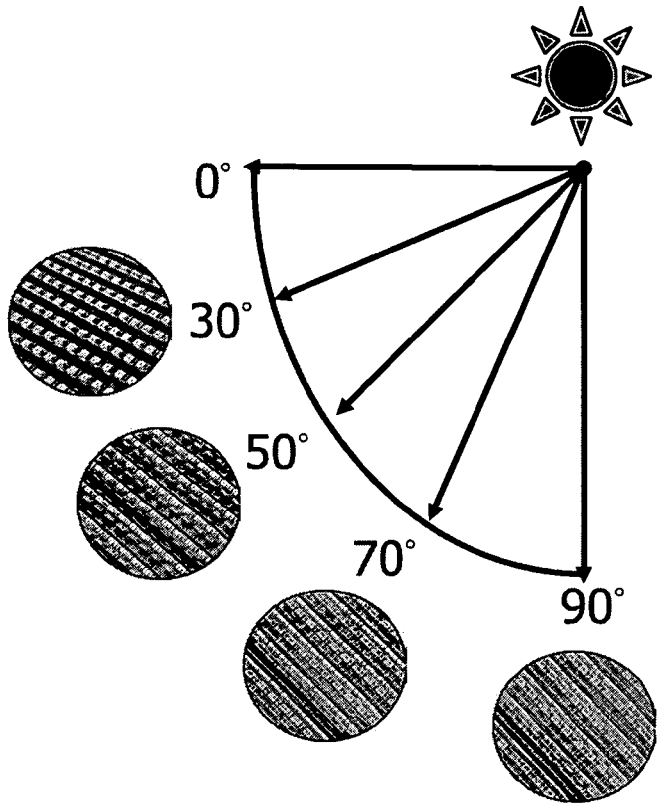
FIG. 4 is one of the preferred embodiments in the present invention showing the transparent image of the three-dimensional soft light textile product under the light from different angles.
Figure 5:
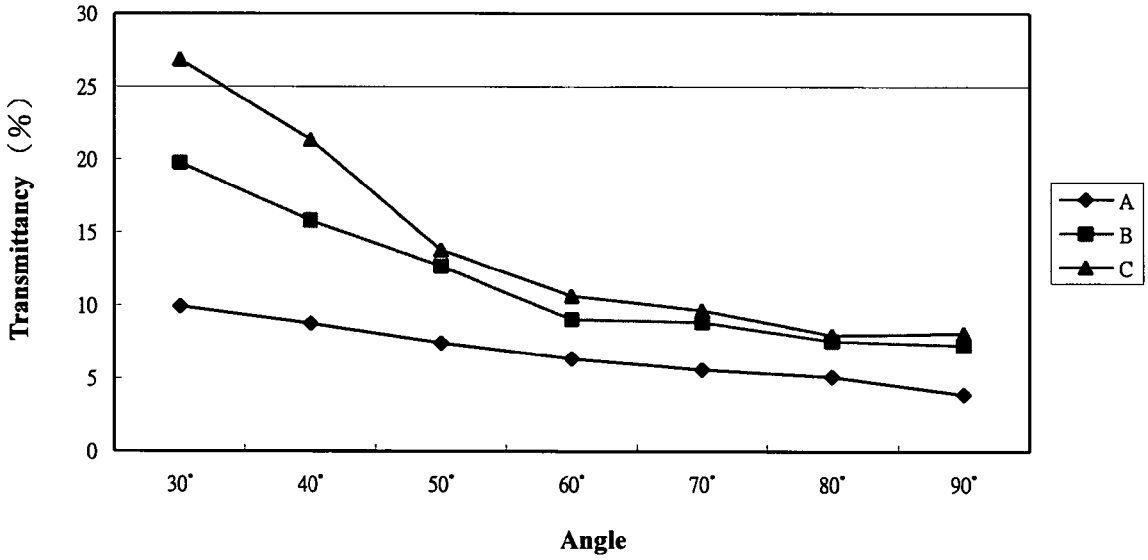
FIG. 5 is one of the preferred embodiments in the present invention showing the curve of the transparent ratio of three-dimensional soft-light textile calculated by the image analysis technique under the light radiated from different angles.

Since JIS L1055 A method cannot measure the illumination under different angles of sunlight to the textile sample, the image analysis technique is applied to conduct the transparent image and transmittancy analysis of lights from different angels to the textile sample. The test result is shown as FIG. 4 and FIG. 5. FIG. 4 demonstrates that from different radiating angles, the transmittable degrees of textile will vary. The transmittancies of textiles are compared based on the ratio of the transparent area taken by image analysis technique. The transmittancy comparison values of the textile are transformed into curve graph as shown in FIG. 5. From the demonstration of FIG. 5, there is a significant variation on the three-dimensional textile with tender light when the radiating angels at 30° to 60°. Along with the decreasing light radiating angles, the transparency effects of the textile are also rising gradually, especially at the radiating angle of 30°. Taking Textile Sample C for example, the transmittancy of Textile Sample C is as high as 26% when the radiating angle is 30°. At the radiating angle of 40°, the transmittancy of Textile Sample C is 21%, and at the radiating angle of 90°, the transmittancy is the lowest while the light shielding rate of Textile Sample C is 92%. When the light radiating angle is lower than 30°, it is unable to conduct the test as the textile surface, projective light, and the CCD camera are almost on a horizontal line. Therefore, the present experiment is conducted until the radiating angle of 30°.

UV Penetration Rate Test

Figure 6:
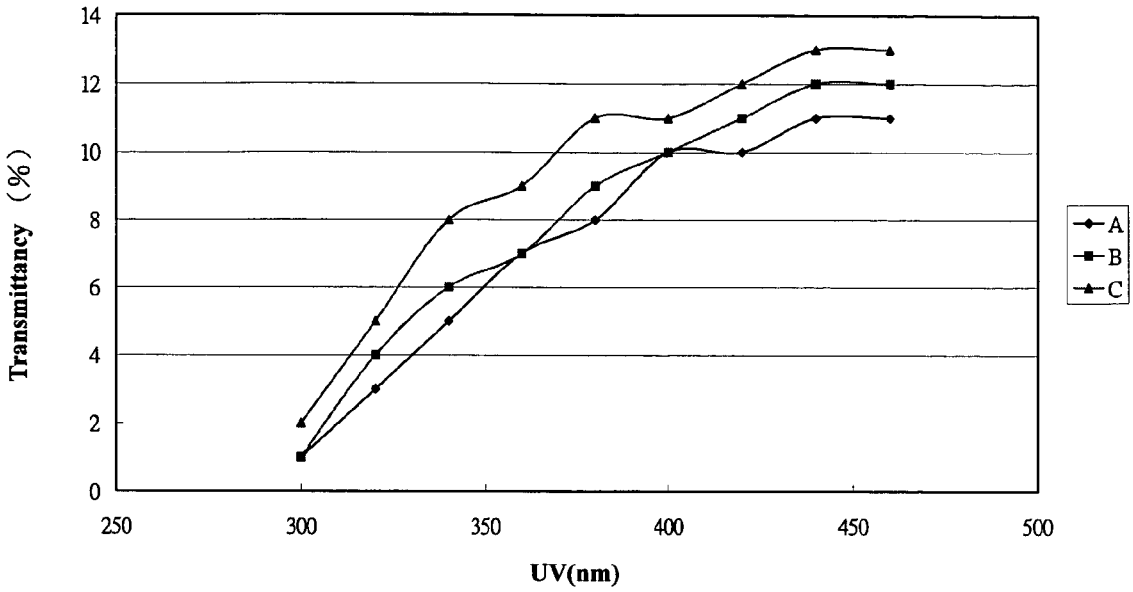
FIG. 6 is another preferred embodiment in the present invention showing the curve of UV penetration rate test of three-dimensional soft-light textile.

As shown in FIG. 6, in addition to Textile Sample C, the penetrations of three-dimensional soft light textile sample A and B are all under 10% at UV-A and UV-B. Take UV of 380 nm for example, the shielding rate of textile sample A is 92% and textile sample B is 91%. As to textile sample C, the distance of construction is shortened and the transmittancy is advance, but the UV penetration is also prompted at the same time as well. However, the shielding rate is still higher than 90% under the UV wavelength of 360 nm. Hence, the control of the balance between transmittancy and UV shielding rate is very important.

Moreover, the UPF value of three-dimensional soft light textile, tested by using Labsphere UltraViolet Transmittance Analyzer, is shown as Table 2. From the test result, the UPF values are all higher than 30 no matter textile sample A, B, or C. Therefore, the test result is converged with the above-mentioned UV penetration test.

TABLE 2

UPF Experimental Result of Three-dimensional Soft-light Textile

| | Textile Label | | |
|---|---|---|---|
| | A | B | C |
| UPF | 36 | 34 | 31 |

Gap Ratio Analysis of the Textile

Via the helium gas expelling method, the actual volume of the textile is measured by using the densimeter. Additionally, the length, width, and height of the textile's appearance are measured to calculate the apparent volume of the textile. The gap ratio of the textile finally is calculated with the following equation, and the result is shown as Table 3.

$$\text{Gap Ratio}=(\text{Apparent Volume}-\text{Real Volume})/\text{Apparent Volume}\times 100\%$$

The gap ratio indicates the quantity of the included air layer. And the quantity of the air layer would influence the heat blocking effect of textile. The gap ratio of the present invented textile is as high as 99% with a lot of air layers. In conclusion, the invented textile of the present invention should be capable of excellent heat insulating effect. Subsequently, the heat insulating property will be analyzed and verified.

TABLE 3

Gap Ratio of the Three-dimensional Soft-light Textile

| | Sample Label | | |
|---|---|---|---|
| | A | B | C |
| Real Volume ($cm^3$) | 0.3560 | 0.3530 | 0.3584 |
| Appearance Volume ($cm^3$) | 99.44 | 98.75 | 98.5 |
| Gap Ratio (%) | 99.64 | 99.64 | 99.64 |

Heat Resistance Value r Test

Table 4 illustrates the heat resistance value r of textile tested by ALAMBETA. The thickness of three-dimensional textile is higher than flat one, so the resistance of three-dimensional textile is also much higher than flat one. Therefore, the air layer formed of the thickness of three-dimensional textile is utilized to block the heat effectively.

TABLE 4

ALAMBETA Test Result of Three-dimensional Soft-light Textile

| Textile Label | Umbrella Textile | Coffee Shop Umbrella Textile | Tent Textile | A | B | C |
|---|---|---|---|---|---|---|
| λ | 21 | 48.9 | 52.1 | 39.35 | 39.65 | 39.975 |
| A | 0.005 | 0.05 | 0.051 | 0.5053 | 0.5283 | 0.564 |
| B | 302.5 | 212 | 231.5 | 55.425 | 54.75 | 53.9 |
| R | 3.85 | 9.85 | 13.9 | 101.15 | 99.625 | 98.475 |
| H | 0.08 | 0.48 | 0.725 | 3.9775 | 3.95 | 3.9375 |
| P | 1.25 | 1.6 | 1.805 | 3.8225 | 3.6925 | 3.9125 |
| Q | 1.32 | 0.92 | 0.795 | 0.265 | 0.266 | 0.2855 |

In addition, the heat insulating property of the window curtain is used as the basis of comparison, and the result of calculation is shown as followings:

A. The U value of the single-layer glass in the metal frame is approximately 6.3 $W.m^{-2}.K^{-1}$.

B. The U value of the single-layer glass window in the metal frame and the general window curtain mostly is 0.75 of the glass window without curtain, ie. 6.3×0.75=4.725 $W.m^{-2}.K^{-1}$.

C. The U value of the single-layer glass window in the metal frame and the three-dimensional soft-light textile window curtain:

a. Heat resistance of the inner and outer air $$(1/h_0+1/h_i)=(1/19+1/8.7)=0.1676\ K.m^2.W^{-1}.$$

b. Heat resistance value of the air between window curtain and the glass is 0.044 $K.m^2.W^{-1}$.

c. Heat resistance of the three-dimensional soft-light textile curtain is 0.1 $K.m^2.W^{-1}$.

$$1/U_T=0.1676+0.044+0.1=0.3116\ (K.m^2.W^{-1})$$

$$U_T=3.21(W.m^{-2}.K^{-1})$$

D. The heat insulating effect of the window with the set three-dimensional soft-light textile window curtain is advanced by ⅓ than the general window curtain.

| Quantity | Symbol | Multiplier | Unit |
|---|---|---|---|
| Thermal conductivity (coefficient) | λ | $10^{-3}$ | $W \cdot m^{-1} \cdot k^{-1}$ |
| Thermal diffusivity (coefficient) | a | $10^{-6}$ | $m^2 \cdot s^{-1}$ |
| Thermal absorptivity, thermal activity coefficient | b | 1 | $W \cdot m^{-2} \cdot s^{1/2} \cdot k^{-1}$ |
| Thermal resistivity | r | $10^{-3}$ | $K \cdot m^2 \cdot W^{-1}$ |
| Sample thickness | h | 1 | mm |
| Peak heat flow density ratio ($q_{1max}/q_s$) | p | 1 | 1 |
| Peak heat flow density ($q_{1max}$) | q | $10^3$ | $W \cdot m^{-2}$ |

Heat Radiation Shielding Rate

Figure 7:
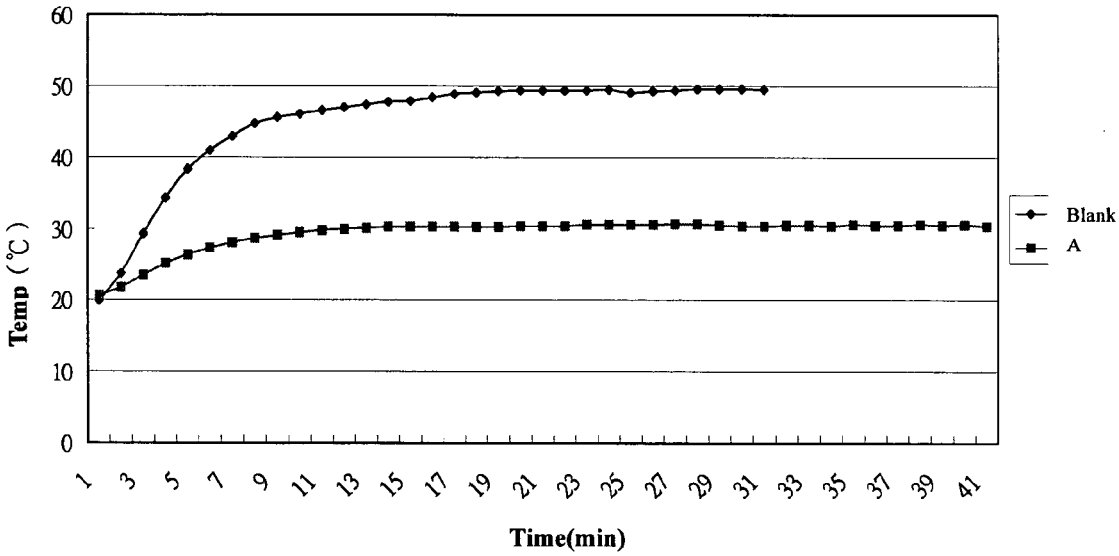
FIG. 7 is one of the preferred embodiments in the present invention showing the curve of heat-insulating analysis of three-dimensional soft-light textile.

The opening heat experiment is adopted by the present invention, wherein the heat source is 500 W halogen light and the textile sample of 50 cm×50 cm is put away from 30 cm. After 40 minutes of radiation, the temperature at the rear of the textile is measured. The temperature $T_1$, 5 cm away from the rear of the textile sample, and the temperature $T_0$, at the same position but without the shielding of textile sample, are taken and to calculate the heat radiation of textile. The test result of textile sample A is shown as FIG. 7. When the test passes 20 minutes, the temperature would reach a horizontal equilibrium. The equilibrium temperature of blank test is 50° C., and the equilibrium temperature of textile sample A is 30° C., and the difference in between is 20° C. After calculating, the heat retaining rate can reach 40%.

The Advantages of the Present Invention:

1. It is easy to weave the textile by using the construction of 2 layers.
2. The contraction difference of high shrinkage-rate yarn and monofilament is utilized to produce the three-dimensional construction effect of textile so as to advance the gap ratio of textile and achieve the significant heat insulating effect.
3. The construction design is adopted in the present invention, and no any flat yarn or special post finishing process is necessary. The general textile can be used to manage relatively high shielding rate.
4. The light permeability of textile can be effectively controlled via construction design so as to form the controllable and adjustable light textile as desire.
5. The round shaft of textile construction and the opening positioned differently from the anisotropic direction to the diagonal direction of warp and weft yarns can advance the light permeability at anistropic direction without the decreasing the shielding rate of vertical direction.
6. Under the fixed construction, the different properties of anisotropic yarn and polyester monofilament can also be used to obtain the textile product with both anisotropic transparent light and heat insulating.
7. The textile product with dazzling light shielding and soft-light permeable effect can be developed via the construction design of textile. Besides, it is also capable of aesthetic values of color and pattern design.

The above-mentioned practice is only a preferred embodiment of this invention, not the specified limit of it. All the parallel changes and revisions of the shape, the structure, the feature, and the spirit evolving from this invention should be included in the field of the claimed patent of this invention.

What is claimed is:

1. A manufacturing method of textile with transparent light and heat insulating construction comprising the steps of:

weaving a multiple of yarns, wherein including transparent weft yarns, non-transparent weft yarns, a multiple of warp yarns, and a multiple of high shrinkage-rate yarns as a consecutive surface layer and a consecutive underlying layer with said high shrinkage-rate yarns, wherein said high shrinkage-rate yarns are between the consecutive surface layer and the consecutive underlying layer, and the shrinkage-rate of said high shrinkage-rate yarns is higher than the shrinkage-rate of the consecutive surface layer and the consecutive underlying layer; and contracting said high shrinkage-rate yarns and forming protrusions of the consecutive surface layer and the consecutive underlying layer separately by using thermal treatment.

2. The manufacturing method as claimed in claim 1, wherein the arrangement ratio of the transparent yarns to the non-transparent yarns in the consecutive surface layer is reverse to the arrangement ratio of the transparent yarns to the non-transparent yarns in the consecutive underling layer while weaving the consecutive surface layer and the consecutive underlying layer.

3. The manufacturing method as claimed in claim 2, wherein said transparent yarns and said non-transparent yarns of the consecutive surface layer and the consecutive underlying layer are controlled to obtain different transmittancy.

4. The manufacturing method as claimed in claim 1 wherein the shrinkage rate of said high shrinkage-rate yarns is controlled to obtain different thickness of the textile products.

5. A textile with transparent light and heat-insulating construction mainly comprising:

a protruding surface layer including first weft yarns with first transparent yarns and first non-transparent yarns;

a multiple of high shrinkage-rate yarns with the protruding surface layer thereon;

an protruding underlying layer with said high shrinkage-rate yarns thereon, wherein the protruding underlying layer includes second weft yarns with second transparent yarns and second non-transparent yarns;

wherein the shrinkage-rate of said high shrinkage-rate yarns is higher than the shrinkage-rate of the protruding surface layer and the protruding underlying layer, and the textile with different transmittancy can be managed by controlling said first transparent yarns, said first non-transparent yarns, said second transparent yarns, and said second non-transparent yarns.

6. The textile construction as claimed in claim 5, wherein the transmittancy can be controlled by the arrangement ratio of said transparent yarns to said non-transparent yarns of the protruding surface layer and the protruding underlying layer.

7. The textile construction as claimed in claim 6, wherein said arrangement ratio locates between 1/5 and 5/1.

8. The textile construction as claimed in claim 5, wherein further comprising a fist air layer is placed between the protruding surface layer and said high shrinkage-rate yarns.

9. The textile construction as claimed in claim 8, wherein the volume of said first air layer is 10%.about.49% of the textile product.

10. The textile construction as claimed in claim 5, wherein further comprising a second air layer is placed between the protruding underlying layer and said multiple high shrinkage-rate yarns.

11. The textile construction as claimed in claim 10, wherein the volume of said second air layer is 10%.about.49% of the textile product.

12. The textile construction as claimed in claim 5, wherein the shrinkage rate of said multiple high shrinkage-rate yarns is between 20% and 60%.

13. The textile construction as claimed in claim 5, wherein the yarns of 50.about.1000 denier are used on said multiple high shrinkage-rate yarns.

14. The textile construction as claimed in claim 5, wherein said first transparent yarns and said first non-transparent yarns of the protruding surface layer is arranged in the opposite position to said second transparent yarns and said second non-transparent yarns of the protruding underlying layer.

* * * * *